United States Patent [19]

Post Jr.

[11] Patent Number: 4,825,508

[45] Date of Patent: May 2, 1989

[54] SIMULATED STRAP HINGE

[76] Inventor: Russell H. Post Jr., 162 Kingston Rd., Kingston, N.H. 03848

[21] Appl. No.: 131,014

[22] Filed: Dec. 10, 1987

[51] Int. Cl.[4] ..... E05D 11/00

[52] U.S. Cl. ..... 16/250

[58] Field of Search ..... 16/250, 251

[56] References Cited

U.S. PATENT DOCUMENTS

| | | | |
|---|---|---|---|
| 1,167,444 | 1/1916 | Stevenson | 16/251 |
| 2,169,059 | 8/1939 | Soss et al. | 16/251 |
| 2,809,456 | 10/1957 | Knapp | 16/251 |

*Primary Examiner*—Fred A. Silverberg
*Attorney, Agent, or Firm*—Lee A. Strimbeck

[57] ABSTRACT

A simulated strap hinge consists of a molded plastic sheet with down turned edges in the shape of a strap hinge and having a butt portion that mates with and covers one plate of a standard butt hinge. The turned down edges stand the sheet off from surface on which the simulated hinge rests. The strap portion has screw-receiving dimples that serve to hold the center of the strap away from the surface onto which the simulated strap hinge is being mounted.

4 Claims, 1 Drawing Sheet

SIMULATED STRAP HINGE

This invention is a stimulated strap hinge for decorative use on doors. More particularly, it is a butt hinge cover of molded plastic that looks like a forged iron strap hinge.

INTRODUCTION

Forged iron strap hinges are expensive. Depending upon the size, they may cost as much as $ 20.00–$ 35.00 a pair for sizes of 12 to 18 inches. This makes them far too expensive for low cost constructions, such as for doors on small utility sheds.

Yet, as such sheds are often placed in a yard where they are quite visible, it is desirable to add to the shed decorative touches. This also makes them more saleable as sample sheds are usually put on display at dealer outlets.

The doors of these sheds are customarily affixed with butt hinges. Others have sought to improve the appearance of such doors by placing on the doors die cut plastic straps simulating the strap of a strap hinge. The plastic strap abuts the plate of the butt hinge but does not cover the plate. The plastic strap is cut from a thin sheet material and does not appear to the eye to have the thickness of a true strap hinge. The die cut sheet material tends to buckle or warp. This apparent lack of substance and the buckling coupled with the fact that the strap simply abuts the butt hinge plate makes the strap look fake and gives the overall appearance of being cheap and shoddy. Such die cut straps do not give the effect of a quality construction.

There has been therefore a desideratum for a low-cost decorative strap hinge for inexpensive constructions. This invention is addressed to this need.

THIS INVENTION

In brief compass, this invention is a butt hinge cover simulating a strap hinge. This cover is of molded plastic of unitary construction in the shape of a strap hinge having a butt portion and a strap portion. The cover has turned down edges providing a gap between the cover and the surface upon which the cover is to rest to give a thickness thereto equal to the thickness of a regular forged iron strap hinge. There are indentations in the strap portion adapted to receive screws. The indentations have walls extending to no more than and preferably slightly less than the depth of the gap, the indentations function to hold the surface of the cover away from the surface on which it rests so that when screws are inserted, they do not cause the hollow cover to pull down. At the hinge end of the cover, there is an enlarged area adapted to mate with and cover the plate of a butt hinge.

The butt hinge cover has a thickness preferably in the range usually of 0.040 to 0.100 inch, e.g. 0.060 inch. The edges of the cover are turned down to provide a gap between the cover and surface on which it rests in the range of 1/32 to 3/16 of an inch. In a preferred construction the enlarged area of the butt portion is made to mate with and cover a 3 to 6 inch butt hinge. Also preferred is to have the butt portion down set at least 1/32 inch from the plane of the surface of the strap portion and have it slope slightly downward to the end of the hinge. This provides for a snug fit over the plate of the butt hinge with which it matches. This down slope preferably exceeds ½ degree and will normally be approximately 2 degrees. There is no hinge between the strap and butt portions of the cover.

The butt portion preferably has simulated pan screw heads molded therein.

As in the case of most strap hinges, the outer end of the strap can be embellished in some manner as with a bean shaped, spear shaped or square end. It is of course quite desirable that the whole of the hinge be black and have an outer surface molded to simulate the hammered finish characteristic of a forged iron hinge.

DRAWING

DESCRIPTION

Figure 1:
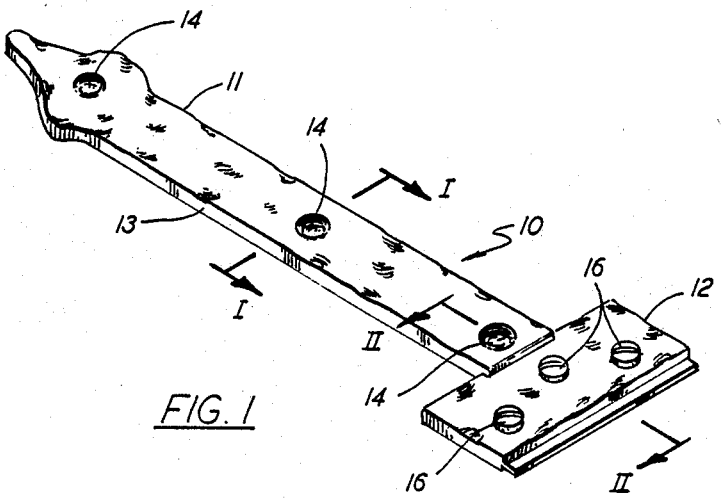
FIG. 1 is a perspective view of a hinge cover made in accordance with the teachings of this invention.
Figure 2:
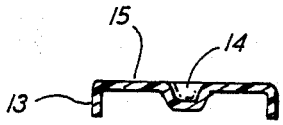
FIG. 2 is a cross-section, not to scale, taken along line I—I of FIG. 1.
Figure 3:
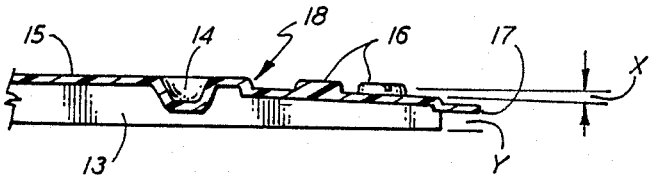
FIG. 3 is a similar cross-section view taken along line II—II of FIG. 1

With reference to the drawing, 10 indicates generally a simulated strap hinge made in accordance with this invention of a molded plastic. The plastic used can be any of the usual weather resistance thermally formable plastics such as: ABS, polyvinylchloride and polypropylene homo and copolymers. Normally the plastic will be carbon-filled to give a black mat or semi-gloss surface.

Cover 10 has a strap portion 11 and a butt portion 12. The edges 13, except for the rear edge of the butt portion, are turned down, as indicated, 3/16 to ¼ inch or so, so that the top of the cover will stand off from the surface to which it is attached leaving a gap underneath the cover of preferably 1/16 to ⅝ of an inch. The strap portion has dimples 14 molded into it to receive the screws which are to be used to mount the cover to the door. The underside of these dimples, or indentations, extend to just about the depth of the turned down edges 13, preferably being a few thousandths of an inch less. Thus, when a screw is put through the bottom of a dimple to mount the cover, the side walls of the dimple cause the top surface 15 of the cover to stand off and prevent the screw from pulling surface 15 down. If pulled down, this would give a concavity and spoil the strap hinge look.

The butt portion 12 of the cover preferably has molded therein simulated screw heads 16. Preferably the butt portion 12 is stepped down or down set at least 1/32 inch e.g. 1/16 inch at 18 and then tapers as is indicated at X at least 1½ degrees downwardly, e.g., 2 degrees. This helps assure that the butt portion 12 fits snugly over the butt hinge to which it is to be mated. The down turned edges of the butt portion 12 are molded to fit exactly over a standard butt hinge preferably one having a size in the range of 2–6 inches. If made to cover a 4 inch butt hinge plate, the cover will have a length usually of at least 16 inches.

While not mandatory, it has been found that it is desirable for the outer edge of the butt portion 12 not to turn completely downward but to leave slight gap, say ⅛ inch, as indicated at Y and to have a trim tab 17 extend outwardly therefrom ⅛ to ¼ inch. After the cover is mounted over the butt hinge on the door, a knife can be used to trim tab 17 to give the appearance of a good fit.

As previously indicated, and as illustrated by the shading on the drawing, the whole of the cover is molded as by compression molding to have the appearance of a hammered iron hinge. This coupled with the down turning of the edges 13 to give some apparent thickness of the cover makes for a very realistic looking simulated strap hinge.

What is claimed is:

1. A butt hinge cover simulating a strap hinge comprising a molded plastic cover having a thickness in the range of 0.040 to 0.100 inch thick and of one-piece construction in the shape of the strap hinge having a butt portion and a strap portion, said butt portion mating with and covering a standard size butt hinge , said cover having (1) turned down edges providing a gap in the range of 1/32 to 3/16 inch between the cover and the surface upon which the cover is to rest and (2) indentions in the strap portion adapted to receive screws, said indentation having walls extending to no more than the depth of said gap, said butt portion being an enlarged area adapted to mate with and cover the entire plate of one-half of the butt hinge, said gap making said strap portion completely hollow thereunder, the enlarged area has simulated screw heads molded therein, said strap portion ends in an enlarged decorative portion and the whole of the hinge cover is black and has molded in the outer surface thereof a simulated hammered finish.

2. The butt hinge cover of claim 1 wherein said enlarged area relative to the plane of the strap portion of said cover is down set and slopes slightly downwardly to the end of the hinge.

3. The butt hinge cover of claim 2 wherein the slope of enlarged area exceeds 1½ degrees.

4. The butt hinge cover of claim 1 having a length overall of at least 16 inches and said butt portion mates with and covers the plate of a 4 inch butt hinge.

* * * * *